United States Patent [19]

Scott

[11] Patent Number: 4,893,772

[45] Date of Patent: Jan. 16, 1990

[54] FITTING FOR WIRE STORAGE PRODUCT

[76] Inventor: William Scott, 505 Bella Capri Dr., Merritt Island, Fla. 32952

[21] Appl. No.: 158,410

[22] Filed: Feb. 22, 1988

[51] Int. Cl.[4] ..... A47G 29/02

[52] U.S. Cl. ..... 248/235; 211/90; 211/168; 248/241; 248/289.1

[58] Field of Search ..... 248/235, 241, 242, 282, 248/289.1; 211/90, 96, 134, 168

[56] References Cited

U.S. PATENT DOCUMENTS

| | | | |
|---|---|---|---|
| 1,751,691 | 3/1930 | Flath | 211/96 X |
| 2,265,542 | 12/1941 | Nofzinger et al. | 248/241 |
| 3,350,856 | 11/1967 | Revell | 248/289.1 X |
| 3,376,007 | 4/1968 | Chesterley | 248/282 |
| 3,598,064 | 8/1971 | Stempel | 211/90 X |
| 3,637,183 | 1/1972 | Sagers | 248/235 |
| 4,261,155 | 4/1981 | Gilb | 248/282 X |
| 4,316,593 | 2/1982 | Miner et al. | 211/90 X |
| 4,374,498 | 2/1983 | Yellin | 248/250 X |
| 4,717,104 | 1/1988 | Lee | 248/235 |

FOREIGN PATENT DOCUMENTS

| | | | |
|---|---|---|---|
| 0281154 | 12/1927 | United Kingdom | 211/90 |

*Primary Examiner*—Ramon O. Ramirez

*Attorney, Agent, or Firm*—Steele, Gould & Fried

[57] ABSTRACT

A fitting is provided for securing a wire storage product to a surface at any of a plurality of relative angles. The fitting includes a base portion for connection to the surface. A bracket portion includes structure for engaging the wire storage product. Hinge structure connects the base portion to the bracket portion, whereby the bracket portion can be pivoted about the hinge structure to engage the wire storage product at any of a plurality of relative angles.

4 Claims, 5 Drawing Sheets

FIG. 1
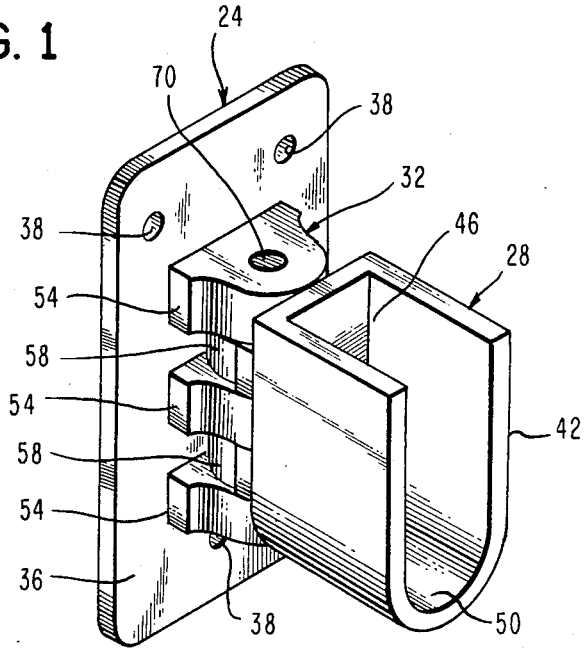
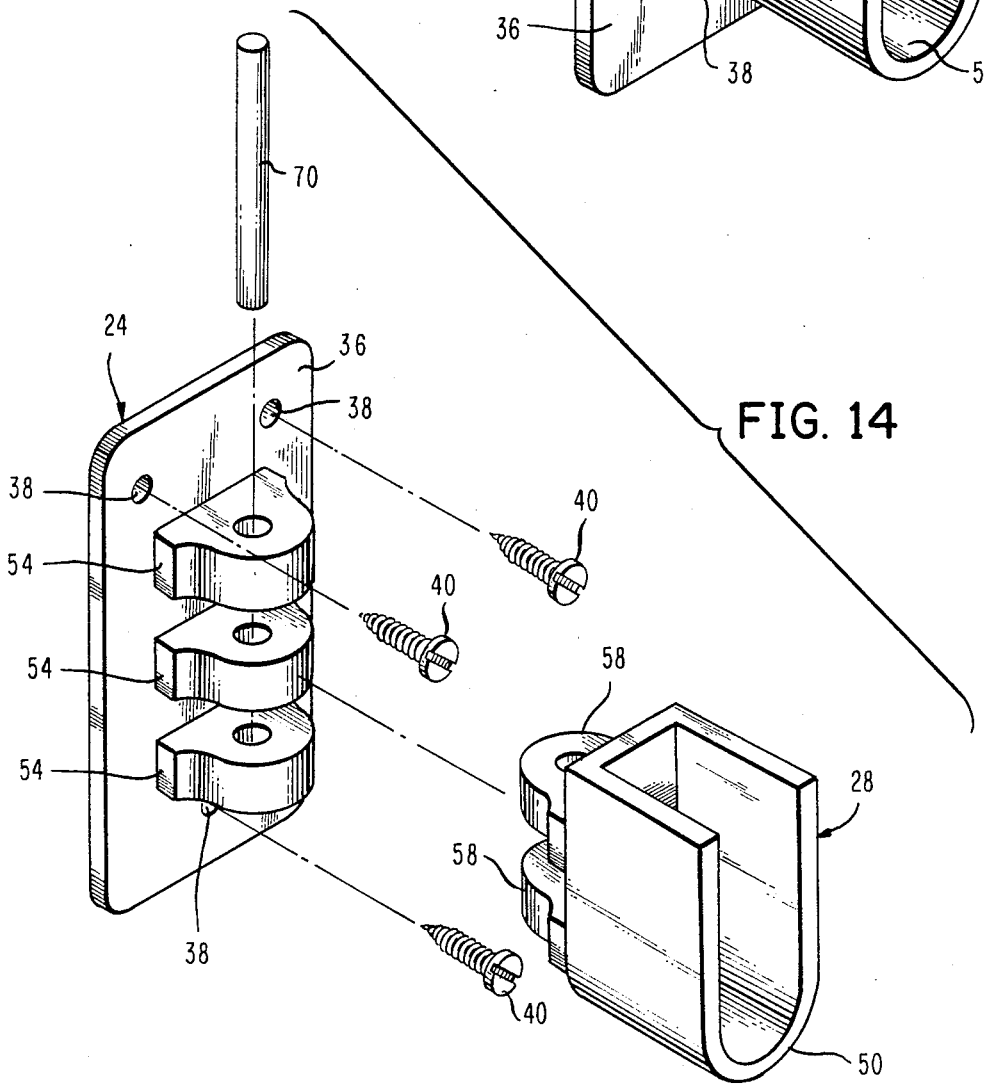
FIG. 14

FIG. 6
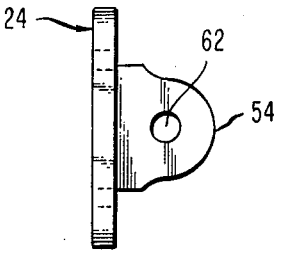
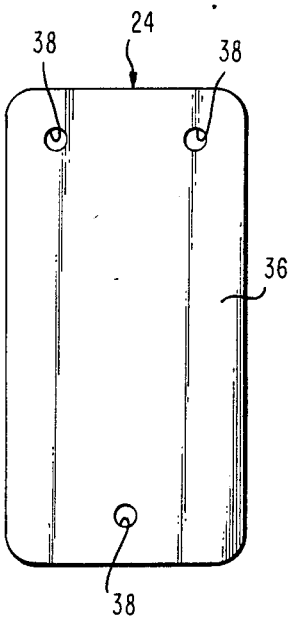
FIG. 2
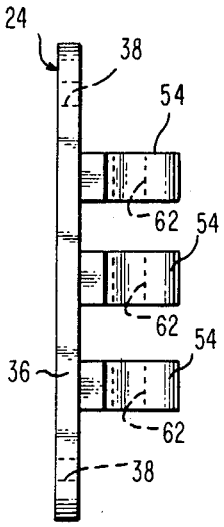
FIG. 3
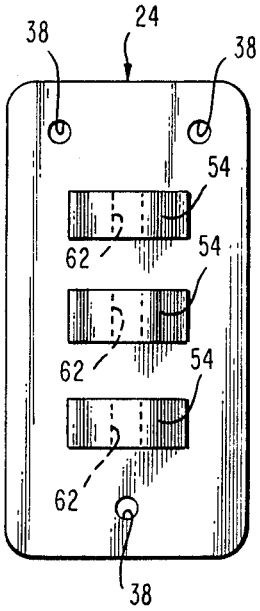
FIG. 4
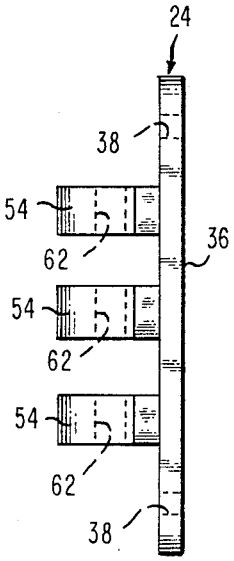
FIG. 5
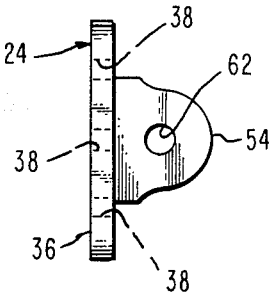
FIG. 7

FIG. 12
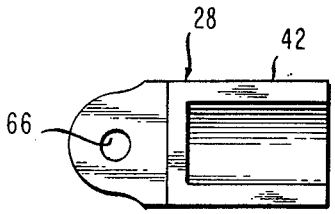
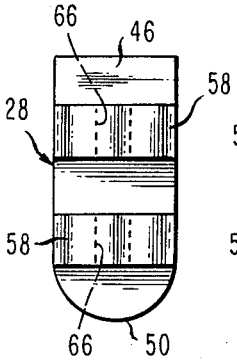
FIG. 8
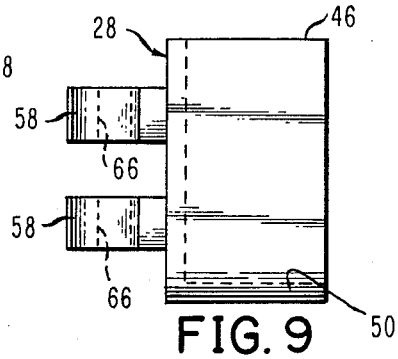
FIG. 9
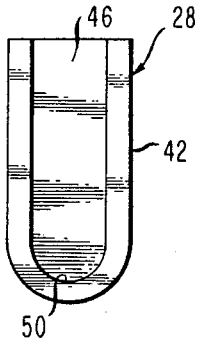
FIG. 10
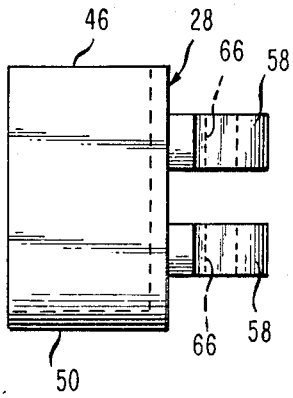
FIG. 11
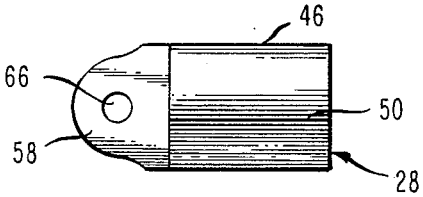
FIG. 13

FITTING FOR WIRE STORAGE PRODUCT

BACKGROUND OF THE INVENTION

1. Field of the Invention

This invention relates generally to wire storage products, and more particularly to fittings for securing wire storage products to surfaces.

2. Description of the Prior Art

Wire storage product include shelving, storage bins, shoe racks, and the like. These products are made from a relatively heavy gauge wire that commonly is coated with a durable plastic material. Wire storage products are lightweight, inexpensive, durable, and easy to clean. Similarly designed products have also been constructed from other materials such as wood.

Wire storage products commonly are installed between wall surfaces and cabinet surfaces that are either parallel or perpendicular to one another. The wire storage products are installed with the aid of fittings that engage the products and which, in turn, are fastened to the surface by suitable fastening structure such as screws. These fittings typically are of an one piece, rigid construction.

Custom installations between surfaces that are not parallel or perpendicular to one another often require that the fitting engage the wire storage product at an irregular angle. These installations are difficult and time consuming to perform.

SUMMARY OF THE INVENTION

It is an object of the invention to provide a fitting for securing a wire storage product to a surface at any of a plurality of relative angles.

It is another object of the invention to provide a fitting which is durable.

It is still another object of the invention to provide a fitting which is easy to install.

It is yet another object of the invention to provide a fitting that is inexpensive to manufacture.

These and other objects are accomplished by a fitting for securing a wire storage product or the like to a surface which comprises a base portion for connection to the surface. A bracket portion includes means for engaging the wire storage product. Hinge means connect the base portion to the bracket portion, whereby the bracket portion can be pivoted about the hinge structure to engage the wire storage product at any of a plurality of relative angles.

The bracket portion preferably comprises an open channel member adapted to receive a portion of the wire storage product. The channel preferably comprises at least one open end whereby a portion of the wire storage product can be positioned in the channel by moving the portion of the wire storage product in a direction substantially parallel to the surface and through the open end into the channel.

The hinge structure preferably comprises hinge members on each of the base portion and the bracket portion. Each of the hinge members have a bore. Hinge members on the bracket portion are adapted to interfit with hinge members on the base portion such that the bores align. A hinge pin is adapted for insertion into the aligned bores to hold the hinged joint together.

The base portion preferably is substantially planar and comprises means to secure the base portion to the surface. The means for securing the base portion to the surface preferably comprises at least one aperture in the base portion adapted to receive fastening means.

A method is also provided for installing a wire storage product to a surface. The method comprises the steps of fixing to the surface a fitting comprising a base portion, a bracket portion having means for engaging the wire storage product, and hinge means connecting the base portion to the bracket portion. The wire storage product is set substantially in place with a portion of the wire storage product being positioned adjacent to the fitting. The bracket portion of the fitting is pivoted about the hinge means to align with the adjacent portion of the wire storage product. The portion of the wire storage product adjacent the bracket is then engaged to the bracket.

BRIEF DESCRIPTION OF THE DRAWINGS

There are shown in the drawings embodiments which are presently preferred it being understood, however, that the invention is not limited to the precise arrangements and instrumentalities shown, wherein:

FIG. 1 is a perspective of a fitting according to the invention.

FIG. 2 is a rear elevation of a base portion.

FIG. 3 is a right side elevation of a base portion.

FIG. 4 is a front elevation of a base portion.

FIG. 5 is a left side elevation of a base portion.

FIG. 6 is a plan view of a base portion.

FIG. 7 is a bottom view of a base portion.

FIG. 8 is a rear elevation of a bracket portion.

FIG. 9 is a right side elevation of a bracket portion.

FIG. 10 is a front elevation of a bracket portion.

FIG. 11 is a left side elevation of a bracket portion.

FIG. 12 is a plan view of a bracket portion.

FIG. 13 is a bottom view of a bracket portion.

FIG. 14 is an exploded view of a fitting according to the invention.

DETAILED DESCRIPTION OF THE PREFERRED EMBODIMENTS

Figure 15:
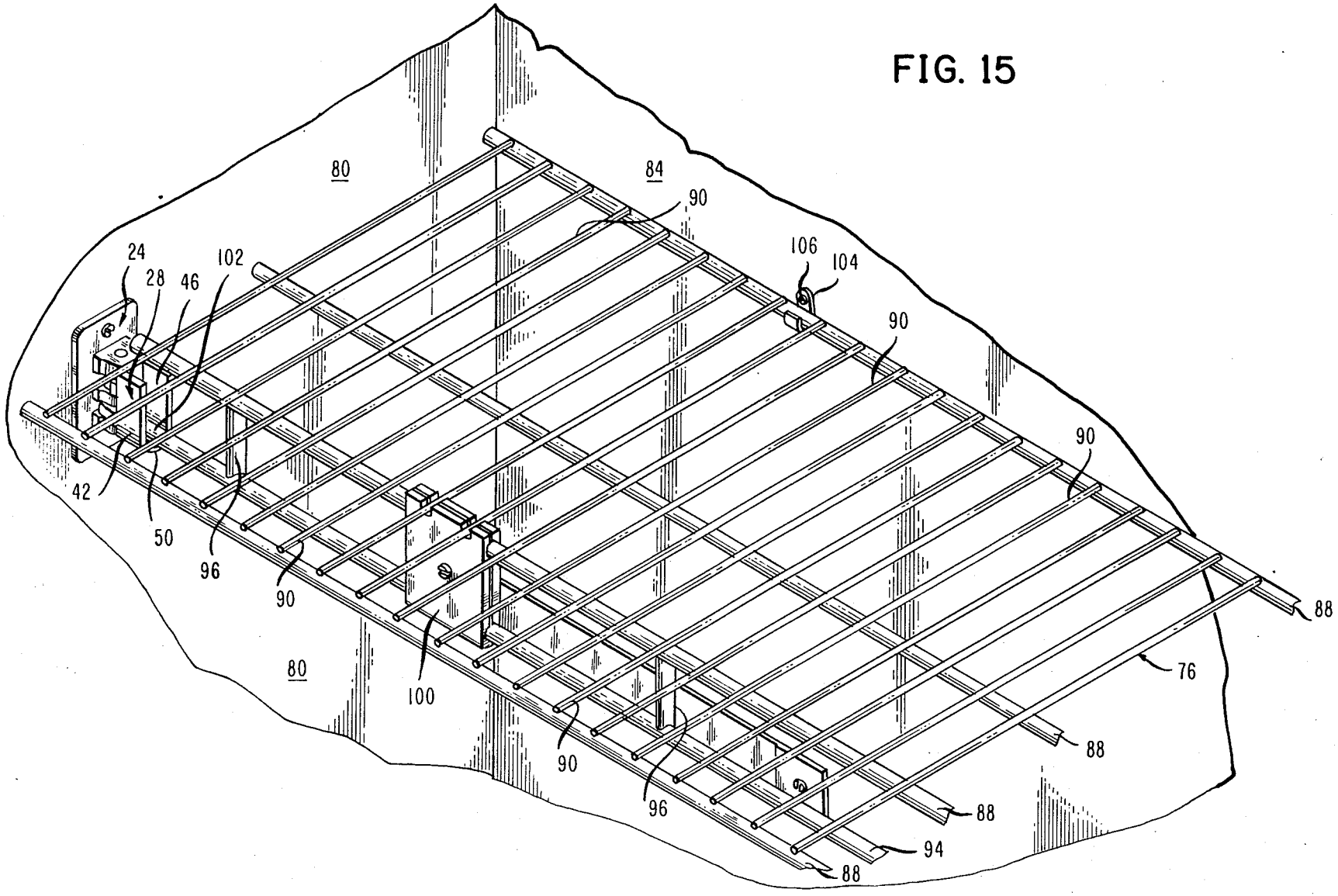
FIG. 15 is a perspective of a wire storage product installed between perpendicularly aligned walls.

A fitting for securing a wire storage product or the like to a surface is shown in FIGS. 1–14. The fitting comprises a base portion 24, a bracket portion 28, and hinge means 32 connecting the base portion to the bracket portion. The base portion 24 preferably includes a support member such as the support plate 36. The support plate 36 is preferably planar and includes means for engaging the surface. A means for engaging the surface can be one or more apertures 38 adapted to receive suitable fastening means such as screws 40.

The bracket portion 28 preferably comprises an open channel member 42. It preferably is substantially U-shaped in cross-section to define a channel. An end 46 of the channel member 42 is preferably open to permit the sliding insertion of a portion of a wire storage product. An opposing end 50 is closed to securely retain the wire storage product in the four-sided compartment so formed.

Hinge means 32 connects the base portion 24 to the bracket portion 28. The hinge means preferably comprise at least one hinge member on the base portion 24 such as the three hinge members 54 and at least one hinge member on the bracket portion 28 such as the two hinge members 58.

The hinge members 54 have a bore 62 and the hinge members 58 have a bore 66. The hinge members 54 on the base portion 24 are adapted to interfit with the hinge members 58 on the bracket portion 28. The bores 62 on the hinge members 54 are adapted to align with the bores 66 on the hinge members 58. The passage so formed is adapted to receive a hinge pin 70 to pivotally secure the joint together.

Other hinge means are possible. Hinge means could be provided as an elastomeric flap attached to both the base portion 24 and the bracket portion 28. The elastomeric flap would be sufficiently rigid to secure the bracket portion 28 to the base portion 24 but would be flexible enough to permit pivoting of the bracket portion 28 with respect to the base portion 24. This embodiment would have the advantage of a one-piece construction which could be made in substantially a single molding.

Figure 16:
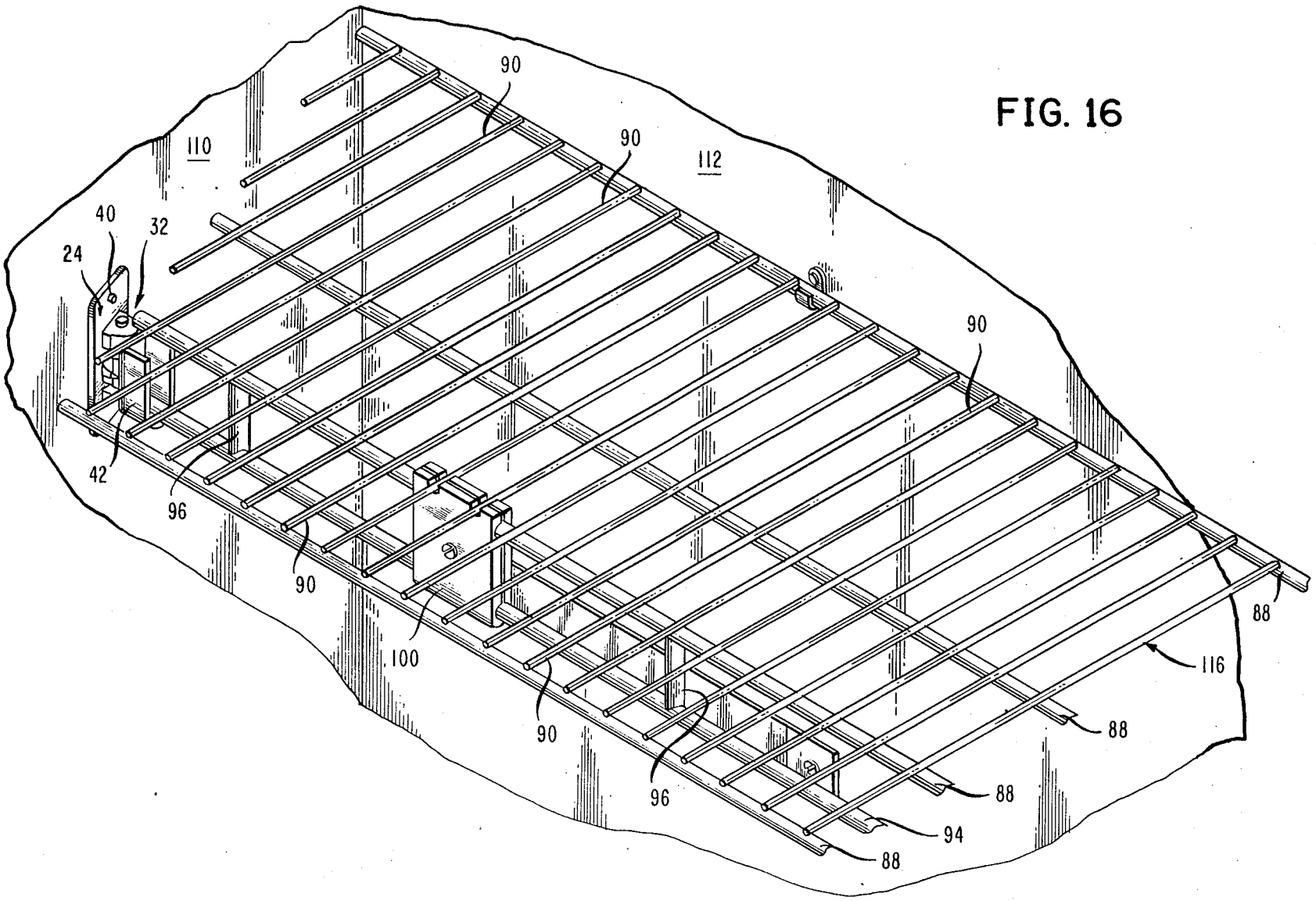
FIG. 16 is a perspective showing a wire storage product installed between walls aligned at an acute angle.

The installation of a wire storage product with the fitting of the invention is depicted in FIGS. 15–16. In FIG. 15 there is shown a wire storage product 76 that is installed between perpendicular walls 80 and 84. The wire storage product 76 is of the wire shelving construction, although it will be understood that the principles disclosed herein will be readily applicable to other types of wire storage products. The wire shelving product 76 typically includes a number of relatively heavy gauge longitudinal rods 88. A plurality of relatively smaller gauge transverse rods 90 are fixed to the longitudinal rods 88 to form the wire shelving product. The longitudinal rods 88 are usually substantially coplanar to provide a planar shelf. Wire shelving products sometimes also include a support rod 94 that can be of the same gauge as the longitudinal rods 88. The support rod 94 is provided to give additional support strength and buckling resistance to the shelf where it is needed most, usually toward the front or leading edge of the shelf 76 as shown. The support rod 94 can be joined to the longitudinal rods 88 by suitable connecting rods 96. Additional strength can be obtained by a joining plate 100, which is adapted to clamp the support rod 94 to at least one of the longitudinal rods 88.

An end 102 of the support rod 94 is positioned in the channel member 42 of the bracket portion 28 where it rests securely on the closed end 50. The fitting is secured to the wall by a screw 40 through the aperture 38 in the base portion 24. The open end 46 permits the installer to position an adjacent end 102 of the support rod 94 into the channel of the channel member 42. The wire storage product could alternatively be supported by positioning one of the longitudinal rods 88 in the open channel member 42. The wire shelving product 76 can also be additionally fastened to the wall by suitable fastening means known in the art such as the clip 104 that is secured to the wall by a screw 106.

The invention is particularly well suited for the installation of wire storage products between walls that are related at irregular angles as illustrated in FIG. 16. The walls 110, 112 are aligned at an acute angle. A wire shelving product 116 also comprising longitudinal rods 88, transverse rods 90, and support rods 94, has been trimmed to substantially match the contour of the walls. The fitting of the invention is fixed to the surface 110 by suitable fastening structure such as screws 40. The base portion 24 is aligned irregularly at an obtuse angle with the support rod 94. The channel member 42 can pivot relative to the base portion 24 about the hinge means 32 so that the support rod 94 can be positioned in and engaged to the channel member 42.

The invention is particularly well suited for use with wire storage products. The invention can also be used, however, with similarly designed products made from alternative materials such as wood.

The invention provides a method for quickly and easily installing wire storage products to surfaces. The wire storage product is trimmed to fit the space, if necessary. The fitting is fixed to the surface by securing the base portion 24 to the wall with screws 40 or other suitable fastening means at a position where the bracket portions 28 will be substantially adjacent the end 102 of the support rod 94, or adjacent any other portion of the wire storage product that is to be engaged by the bracket portion. The bracket portion can be pivoted about the hinge means to position the bracket portion adjacent a portion of the wire storage product. The upwardly opening channel member 42 permits the wire storage product to be engaged to the bracket portion 28 by positioning the wire storage product adjacent the bracket portion 28 and permitting a portion of the wire storage product, as the end 102, to drop into the channel of the channel member 42. The wire shelving product 76 can be installed in very tight tolerances by positioning the shelving or otherwise storage product above the fitting and moving a portion of the wire storage product substantially parallel to the surface and into the channel of the channel member 42.

This invention can be embodied in several forms without departing from the spirit or essential attributes thereof, and accordingly, reference should be had to the following claims, rather than to the foregoing specification, as indicating the scope of the invention.

I claim:

1. A fitting for securing a shelf to at least two nearby surfaces, said surfaces being skewed relative to one another, said shelf including at least one support rod, said fitting comprising:

a base portion for connection to one of said surfaces;

a bracket portion having an open channel member adapted to receive an end of said support rod; and, hinge means connecting the base portion to the bracket portion, whereby said base portion of said fitting can be connected to one of said surfaces, whereby the bracket portion can be pivoted about the hinge means relative to the skew angle between said surfaces, so as to permit engagement between said open channel member and said end of said support rod and wherein said channel member comprises at least one upwardly opening channel, whereby an end of said support rod can be positioned in said channel by moving said end of said support rod in a direction substantially parallel to said surface and through said open end into said channel.

2. The fitting of claim 1, wherein the hinge means comprises hinge members on each of said base portion and said bracket portion, each of said hinge members having a bore, said hinge members on said bracket portion being adapted to interfit with said hinge members on said base portion, such that said bores align, and further comprising a hinge pin adapted for insertion into said aligned bores.

3. The fitting of claim 1, wherein the base portion comprises means to secure said base portion to the surface.

4. The fitting of claim 3, wherein said means for securing said base portion to the surface comprises at least one aperture in said base portion adapted to receive fastening means.

* * * * *